US009366198B2

(12) United States Patent
Izumiura et al.

(10) Patent No.: US 9,366,198 B2
(45) Date of Patent: Jun. 14, 2016

(54) MALFUNCTION JUDGING APPARATUS FOR FUEL FEEDING APPARATUS AND MALFUNCTION JUDGING METHOD FOR FUEL FEEDING APPARATUS

(71) Applicant: HONDA MOTOR CO., LTD., Tokyo (JP)

(72) Inventors: Atsushi Izumiura, Wako (JP); Koichiro Shinozaki, Wako (JP); Takahide Mizuno, Wako (JP); Kentaro Onuma, Wako (JP); Yuichi Masukake, Wako (JP)

(73) Assignee: HONDA MOTOR CO., LTD., Toyko (JP)

( * ) Notice: Subject to any disclaimer, the term of this patent is extended or adjusted under 35 U.S.C. 154(b) by 20 days.

(21) Appl. No.: 14/597,220

(22) Filed: Jan. 15, 2015

(65) Prior Publication Data

US 2015/0198107 A1 Jul. 16, 2015

(30) Foreign Application Priority Data

Jan. 16, 2014 (JP) ..... 2014-005762

(51) Int. Cl.
*F02D 41/14* (2006.01)
*F02D 41/30* (2006.01)
(Continued)

(52) U.S. Cl.
CPC ..... *F02D 41/1454* (2013.01); *F02D 41/221* (2013.01); *F02D 41/2454* (2013.01); *F02D 41/3094* (2013.01)

(58) Field of Classification Search
CPC . F02D 41/14; F02D 41/1401; F02D 41/1454; F02D 41/1473; F02D 41/1495; F02D 41/221; F02D 41/2454; F02D 41/2467; F02D 41/30; F02D 41/3094; F02D 2041/224; F02D 2041/2055
USPC ..... 123/294, 299, 304, 305, 674, 676, 677, 123/679, 681; 701/102, 103, 110, 114; 73/114.41–114.43, 114.45, 114.49, 73/114.51
See application file for complete search history.

(56) References Cited

U.S. PATENT DOCUMENTS 5,213,088 A * 5/1993 Harada ..... F02D 41/1443 123/674
5,388,401 A * 2/1995 Nishizawa ..... F01N 3/22 60/274

(Continued)

FOREIGN PATENT DOCUMENTS

JP 2005-009411 1/2005
JP 2009-30615 2/2009

*Primary Examiner* — John Kwon
*Assistant Examiner* — Johnny H Hoang
(74) *Attorney, Agent, or Firm* — Mori & Ward, LLP

(57) ABSTRACT

In a malfunction judging method for a fuel feeding apparatus in an internal-combustion engine, a feedback correction value is calculated based on an air-fuel ratio parameter and a predetermined feedback control algorithm. In which region a load parameter exists among a first region in which only a first fuel feeding apparatus is used, a second region in which only a second fuel feeding apparatus is used, and a third region other than the first region and the second region is determined. The feedback correction value calculated in a case where the load parameter exists in the first region is determined as a first learned value using a predetermined first learning method. The feedback correction value calculated in a case where the load parameter exists in the second region is determined as a second learned value using a predetermined second learning method.

12 Claims, 9 Drawing Sheets

(51) Int. Cl.
*F02D 41/22* (2006.01)
*F02D 41/24* (2006.01)

(56) References Cited

U.S. PATENT DOCUMENTS 6,026,794 A * 2/2000 Kadowaki ..... F02D 41/22 123/674
6,431,160 B1 * 8/2002 Sugiyama ..... F02D 41/2454 123/480
7,150,266 B2 12/2006 Nakayama et al.
2008/0110447 A1 * 5/2008 Wakahara ..... F02D 41/1438 123/672
2009/0198434 A1 * 8/2009 Tanaka ..... F02D 41/1495 701/103
2010/0168986 A1 * 7/2010 Iwazaki ..... F02D 41/0085 701/103
2010/0263647 A1 * 10/2010 Uchida ..... F02D 19/0602 123/704

* cited by examiner

MALFUNCTION JUDGING APPARATUS FOR FUEL FEEDING APPARATUS AND MALFUNCTION JUDGING METHOD FOR FUEL FEEDING APPARATUS

CROSS-REFERENCE TO RELATED APPLICATIONS

The present application claims priority under 35 U.S.C. §119 to Japanese Patent Application No. 2014-005762, filed Jan. 16, 2014, entitled "Malfunction Judging Apparatus for Fuel Feeding Apparatus." The contents of this application are incorporated herein by reference in their entirety.

BACKGROUND

1. Field

The present disclosure relates to a malfunction judging apparatus for a fuel feeding apparatus and a malfunction judging method for a fuel feeding apparatus.

2. Description of the Related Art

Conventionally, the malfunction judging apparatus described in Japanese Unexamined Patent Application Publication No. 2005-9411 is known as a malfunction judging apparatus for a fuel feeding apparatus in an internal-combustion engine. This internal-combustion engine includes, as a fuel feeding apparatus, a single sub fuel injection valve provided in an air intake path, a main fuel injection valve provided for each cylinder so as to inject fuel into the cylinder, an air-fuel ratio sensor provided in an exhaust path, and the like.

According to this malfunction judging apparatus, first, malfunction of the main fuel injection valve is judged on the basis of a detection signal of the air-fuel ratio sensor (Step 101), and in a case where the main fuel injection valve is normal and is in a high-load range, fuel injection using the main fuel injection valve and the sub fuel injection valve is executed (Step 106). Next, the amount of injection flow injected by the sub fuel injection valve is calculated on the basis of a detection signal of the air-fuel ratio sensor (Step 108), and in a case where the amount of injection flow is not within a normal range, it is determined that the sub fuel injection valve has malfunctioned (Step 111).

Furthermore, conventionally, the method described in Japanese Unexamined Patent Application Publication No. 2009-30615 is known as a control method of calculating a feedback correction coefficient according to a predetermined feedback control algorithm so that an air-fuel ratio of an exhaust gas in an exhaust path converges to a target value during running of an internal-combustion engine for a vehicle and learning such a feedback correction coefficient as a learned value. This internal-combustion engine is one that is applied to a hybrid vehicle further including a motor and includes a first fuel injection valve that injects fuel into an air intake path and a second fuel injection valve that injects fuel into a cylinder.

According to this control method, in a case where a battery level SOC is sufficient, the internal-combustion engine is controlled to be in a normal running state, and the motor is controlled so that shortage of output of the internal-combustion engine is compensated by output of the motor. During normal running of the internal-combustion engine, a learned value of a feedback correction coefficient is calculated in a case where fuel injection using only one of the first fuel injection valve and the second fuel injection valve is being executed. That is, a first learned value obtained in a case where only the first fuel injection valve is used and a second learned value obtained in a case where only the second fuel injection valve is used are calculated as learned values.

SUMMARY

According to one aspect of the present invention, a malfunction judging apparatus for a fuel feeding apparatus that judges malfunction of a first fuel feeding apparatus and a second fuel feeding apparatus which feed fuel into an air intake path and a cylinder of an internal-combustion engine, respectively includes an air-fuel ratio parameter detecting unit, a load parameter detecting unit, a feedback correction value calculating unit, a fuel control unit, a region judging unit, and a malfunction judging unit. The air-fuel ratio parameter detecting unit detects an air-fuel ratio parameter which represents an air-fuel ratio of an exhaust gas flowing through an exhaust path of the internal-combustion engine. The load parameter detecting unit detects a load parameter which represents a load of the internal-combustion engine. The feedback correction value calculating unit calculates a feedback correction value by using the detected air-fuel ratio parameter and a predetermined feedback control algorithm. The fuel control unit controls the amount of fuel fed through the first fuel feeding apparatus and the second fuel feeding apparatus by using the calculated feedback correction value. The region judging unit determines which of a first region, in which only the first fuel feeding apparatus should be used, a second region, in which only the second fuel feeding apparatus should be used, and a region other than the first region and the second region, the detected load parameter is in. The malfunction judging unit, on the basis of a result of the determination of the region judging unit, (i) learns, as a first learned value, a feedback correction value calculated in a case where the load parameter is in the first region by using a predetermined first learning method, (ii) learns, as a second learned value, a feedback correction value calculated in a case where the load parameter is in the second region by using a predetermined second learning method, (iii) judges malfunction of the first fuel feeding apparatus on the basis of the first learned value, and (iv) judges malfunction of the second fuel feeding apparatus on the basis of the second learned value. The malfunction judging unit judges malfunction of the first fuel feeding apparatus and malfunction of the second fuel feeding apparatus by using different methods.

According to another aspect of the present invention, in a malfunction judging method for a fuel feeding apparatus in an internal-combustion engine, an air-fuel ratio parameter which represents an air-fuel ratio of an exhaust gas flowing through an exhaust path of the internal-combustion engine is detected. A load parameter which represents a load of the internal-combustion engine is detected. A feedback correction value is calculated based on the air-fuel ratio parameter and a predetermined feedback control algorithm. A first amount of fuel fed through a first fuel feeding apparatus into an air intake path is controlled based on the feedback correction value. A second amount of fuel fed through a second fuel feeding apparatus into a cylinder of the internal-combustion engine is controlled based on the feedback correction value. In which region the load parameter exists among a first region in which only the first fuel feeding apparatus is used, a second region in which only the second fuel feeding apparatus is used, and a third region other than the first region and the second region is determined. The feedback correction value calculated in a case where the load parameter exists in the first region is determined as a first learned value using a predetermined first learning method. The feedback correction value calculated in a case where the load parameter exists in the second region is determined as a second learned value using a predetermined second learning method. Malfunction of the first fuel feeding apparatus is judged based on the first learned value using a first judging method. Malfunction of the second fuel feeding apparatus is judged based on the second learned value using a second judging method different from the first method.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
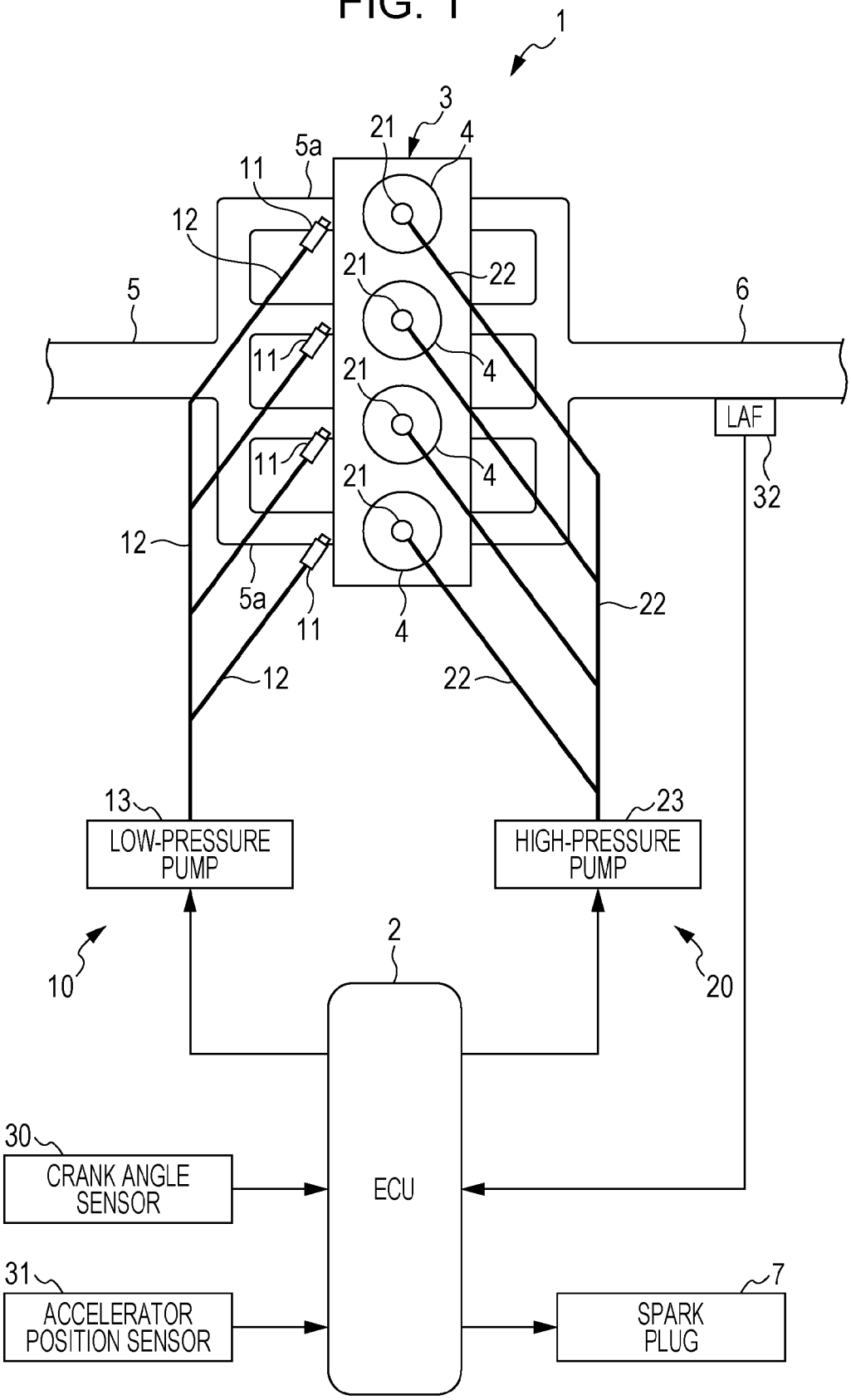
FIG. 1 is a view schematically showing a configuration of a malfunction judging apparatus according to one embodiment of the present disclosure and an internal-combustion engine including a fuel feeding apparatus to which the malfunction judging apparatus has been applied.

The embodiments will now be described with reference to the accompanying drawings, wherein like reference numerals designate corresponding or identical elements throughout the various drawings.

A malfunction judging apparatus for a fuel feeding apparatus according to one embodiment of the present disclosure is described below with reference to the drawings. As illustrated in FIG. 1, a malfunction judging apparatus 1 according to the present embodiment is one applied to a fuel feeding apparatus for an internal-combustion engine (hereinafter referred to as "engine") 3 and includes an ECU 2.

The engine 3 is an in-line four-cylinder type mounted as a motor in a vehicle (not shown) and includes four cylinders 4, an air intake path 5 and an exhaust path 6 connected to these cylinders 4, spark plugs 7 (only one of them is shown) provided for the respective cylinders 4, and the like. The spark plugs 7 are electrically connected to the ECU 2, and the ECU 2 controls an ignition timing, i.e., a spark timing of an air-fuel mixture using the spark plugs 7 during running of the engine 3.

Furthermore, the fuel feeding apparatus includes a first fuel feeding apparatus 10 and a second fuel feeding apparatus 20. This first fuel feeding apparatus 10 is for feeding fuel spray into air-intake ports 5*a* of the air intake path 5, and includes four port fuel injection valves 11, a low-pressure fuel feeding path 12, a low-pressure pump 13, and the like. The low-pressure pump 13 is an electrically driven pump that is electrically connected to the ECU 2, and the running state of the low-pressure pump 13 is controlled by the ECU 2.

The low-pressure pump 13 is connected to a fuel tank (not shown). During running of the low-pressure pump 13, the low-pressure pump 13 feeds fuel in the fuel tank to the port fuel injection valves 11 via the low-pressure fuel feeding path 12. The port fuel injection valves 11 are provided in an in-take manifold of the air intake path 5 so as to face the air-intake ports 5*a* of the cylinders 4 and are electrically connected to the ECU 2. The ECU 2 controls the amount of fuel injected and the injection timing of fuel fed into the air-intake ports 5*a* through the port fuel injection valves 11 as described later.

Meanwhile, the second fuel feeding apparatus 20 is for directly feeding fuel spray into the cylinders 4, and includes four in-cylinder fuel injection valves 21, a high-pressure fuel feeding path 22, a high-pressure pump 23, and the like. This high-pressure pump 23 is connected to a crankshaft (not shown) of the engine 3 and is driven by power of the engine 3 during running of the engine 3.

This high-pressure pump 23 is connected to the fuel tank. During running of the high-pressure pump 23, the high-pressure pump 23 feeds fuel in the fuel tank to the in-cylinder fuel injection valves 21 via the high-pressure fuel feeding path 22 while raising the pressure to a pressure higher than that of the low-pressure pump 13. Furthermore, this high-pressure pump 23 includes a pressure adjusting mechanism (not shown) electrically connected to the ECU 2. The ECU 2 controls the pressure of fuel fed from the high-pressure pump 23 to the in-cylinder fuel injection valves 21 by controlling this pressure adjusting mechanism.

The in-cylinder fuel injection valves 21 are provided for the respective cylinders 4 and attached to a cylinder head so that injection inlets of the in-cylinder fuel injection valves 21 face the insides of the cylinders 4. The in-cylinder fuel injection valves 21 are electrically connected to the ECU 2. The ECU 2 controls the amount of fuel injected and the injection timing of fuel fed into the cylinders 4 through the in-cylinder fuel injection valves 21 as described later.

Furthermore, a crank angle sensor 30, an accelerator position sensor 31, and an LAF sensor 32 are electrically connected to the ECU 2. This crank angle sensor 30 is constituted by a magnet rotor and an MRE pickup, and supplies a CRK signal and a TDC signal, each of which is a pulse signal, to the ECU 2 in accordance with rotation of the crankshaft.

Regarding this CRK signal, one pulse is outputted per predetermined crank angle (e.g.,1°). The ECU 2 calculates the engine rotational speed NE of the engine 3 on the basis of this CRK signal. Meanwhile, the TDC signal is a signal indicating that the pistons (not shown) of the cylinders 4 are located at a predetermined crank angle position that is slightly before a TDC position in an air-intake step, and one pulse is outputted per predetermined crank angle. In the present embodiment, the crank angle sensor 30 corresponds to a load parameter detecting unit, and the engine rotational speed NE corresponds to a load parameter.

The accelerator position sensor 31 detects the amount by which an accelerator pedal (not shown) of the vehicle is pressed down (hereinafter referred to as "accelerator position") AP, and supplies a detection signal indicative of the accelerator position AP to the ECU 2. In the present embodiment, the accelerator position sensor 31 corresponds to the load parameter detecting unit.

The LAF sensor 32 is provided halfway along the exhaust path 6, linearly detects an oxygen concentration in an exhaust gas flowing in the exhaust path 6 over a wide air-fuel ratio range from a rich region in which an air-fuel ratio is richer than a theoretical air-fuel ratio to a markedly lean region, and supplies a detection signal indicative of the oxygen concentration to the ECU 2. The ECU 2 calculates a detected air-fuel ratio KACT indicative of the air-fuel ratio in the exhaust gas on the basis of the value of this detection signal of the LAF sensor 32. This detected air-fuel ratio KACT is specifically calculated as an equivalent ratio. In the present embodiment, the LAF sensor 32 corresponds to an air-fuel ratio parameter detecting unit, and the detected air-fuel ratio KACT corresponds to an air-fuel ratio parameter.

The ECU 2 is realized by a microcomputer made up of a CPU, a RAM, a ROM, an I/O interface (each of which is not shown), and the like, and executes various control processes such as a fuel injection control process in accordance with detection signals of the above-mentioned sensors 30 to 32 as described later.

In the present embodiment, the ECU 2 corresponds to the air-fuel ratio parameter detecting unit, the load parameter detecting unit, a feedback correction value calculating unit, a fuel control unit, a region judging unit, a malfunction judging unit, a combustion state judging unit, a region transition judging unit, and an air-fuel ratio state judging unit.

Next, the fuel injection control process is described with reference to FIG. 2. This control process is a process of calculating the amount of fuel injected and the injection timing of fuel injected through the port fuel injection valves 11 and the in-cylinder fuel injection valves 21, and is executed by the ECU 2 in sync with the timing at which the TDC signal occurs. Note that it is assumed that various values calculated in the following description are stored in the RAM of the ECU 2.

Figure 2:
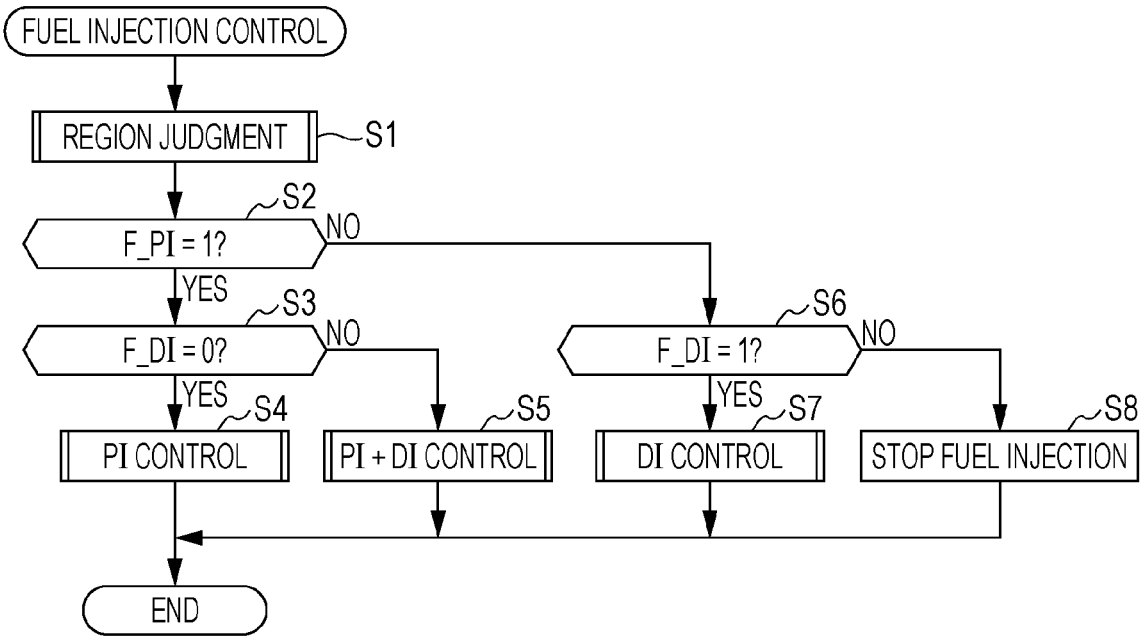
FIG. 2 is a flow chart showing a fuel injection control process.
Figure 3:
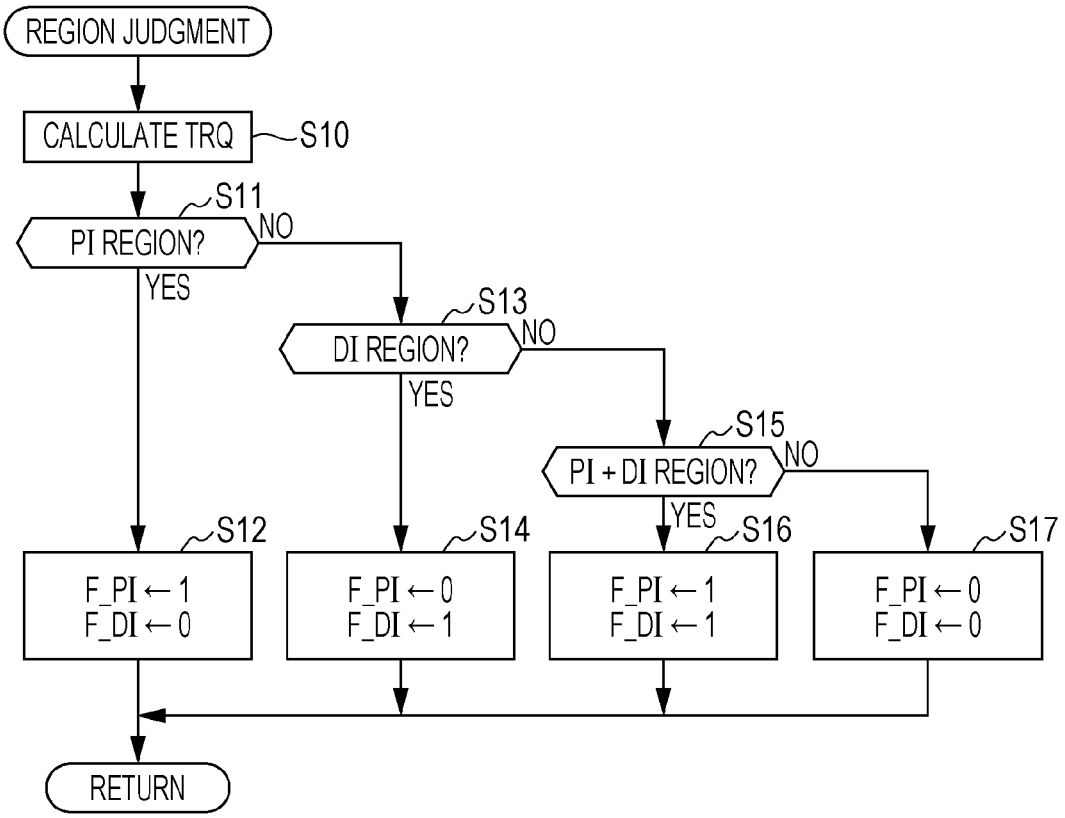
FIG. 3 is a flow chart showing a region judging process.

As illustrated in FIG. 2, first, a region judging process is executed in Step 1. This region judging process is specifically executed as illustrated in FIG. 3. As illustrated in FIG. 3, first, a requested torque TRQ is calculated in Step 10. This requested torque TRQ (load parameter) is torque which a driver requests from the engine 3, and is calculated by searching a map (not shown) in accordance with the engine rotational speed NE and the accelerator position AP.

Next, the process proceeds to Step 11, in which it is determined whether or not a combination of the engine rotational speed NE and the requested torque TRQ is within a PI region. This PI region is a region of low rotational speed and low load that is indicated by "PI" in FIG. 4, and corresponds to a driving region in which fuel injection using only the port fuel injection valves 11 should be executed. In the following description, a control process of executing fuel injection using only the port fuel injection valves 11 is referred to as a "PI control process".

In a case where the result of the determination in Step 11 is YES, that is, in a case where the combination of the engine rotational speed NE and the requested torque TRQ is within the PI region, it is determined that the PI control process should be executed. In order to express this, the process proceeds to Step 12, in which a PI control flag F_PI is set to "1" and a DI control flag F_DI that will be described later is set to "0". Then, this process is finished.

Meanwhile, in a case where the result of the determination in Step 11 is NO, the process proceeds to Step 13, in which it is determined whether or not the combination of the engine rotational speed NE and the requested torque TRQ is within a DI region. This DI region is a hatched region indicated by "DI" in FIG. 4, that is, a region of higher load and higher rotational speed than the PI region, and corresponds to a driving region in which fuel injection using only the in-cylinder fuel injection valves 21 should be executed. In the following description, a control process of executing fuel injection using only the in-cylinder fuel injection valves 21 is referred to as a "DI control process".

In a case where the result of the determination in Step 13 is YES, that is, in a case where the combination of the engine rotational speed NE and the requested torque TRQ is within the DI region, it is determined that the DI control process should be executed. In order to express this, the process proceeds to Step 14, in which the DI control flag F_DI is set to "1" and the PI control flag F_PI is set to "0". Then, this process is finished.

Meanwhile, in a case where the result of the determination in Step 13 is NO, the process proceeds to Step 15, in which it is determined whether or not the combination of the engine rotational speed NE and the requested torque TRQ is within a PI+DI region. This PI+DI region is a region indicated by "PI+DI" in FIG. 4. The PI+DI region is a region of a higher load than the DI region, and corresponds to a driving region in which fuel injection using both of the port fuel injection valves 11 and the in-cylinder fuel injection valves 21 should be executed. In the following description, a control process of executing fuel injection using both of the port fuel injection valves 11 and the in-cylinder fuel injection valves 21 is referred to as a "PI+DI control process".

In a case where the result of the determination in Step 15 is YES, that is, in a case where the combination of the engine rotational speed NE and the requested torque TRQ is within the PI+DI region, the process proceeds to Step 16 in order to express this. In Step 16, both of the PI control flag F_PI and the DI control flag F_DI are set to "1". Then, this process is finished.

Meanwhile, in a case where the result of the determination in Step 15 is NO, it is determined that the combination of the engine rotational speed NE and the requested torque TRQ is within a driving region in which fuel injection should be stopped. In order to express this, the process proceeds to Step 17, in which both of the PI control flag F_PI and the DI control flag F_DI are set to "0". Then, this process is finished.

Returning to FIG. 2, after the region judging process is executed in Step 1 as described above, the process proceeds to Step 2, in which it is determined whether or not the PI control flag F_PI is "1". In a case where the result of this determination is YES, the process proceeds to Step 3, in which it is determined whether or not the DI control flag F_DI is "0". In a case where the result of this determination is YES, the process proceeds to Step 4, in which the PI control process is executed.

Figure 5:
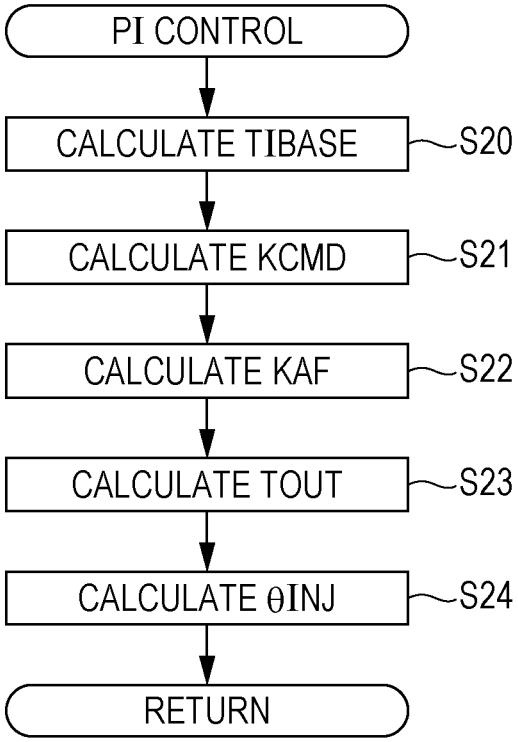
FIG. 5 is a flow chart showing a PI control process.

This PI control process is specifically executed as illustrated in FIG. 5. As illustrated in FIG. 5, first, a basic injection amount TIBASE is calculated by searching a map (not shown) in accordance with the engine rotational speed NE and the requested torque TRQ in Step 20.

Next, the process proceeds to Step 21, in which a target air-fuel ratio KCMD is calculated by searching a map (not shown) in accordance with the engine rotational speed NE and the requested torque TRQ. This target air-fuel ratio KCMD is calculated as an equivalent ratio.

Next, in Step 22, a feedback correction coefficient KAF (feedback correction value) is calculated by using a predetermined feedback control algorithm (e.g., a sliding-mode control algorithm) so that the detected air-fuel ratio KACT converges to the target air-fuel ratio KCMD.

In Step 23 following Step 22, a final fuel injection amount TOUT is calculated. Specifically, a requested injection amount TCYL is calculated as a product TIBASE·KCMD·KAF of the basic injection amount TIBASE, the target air-fuel ratio KCMD, and the feedback correction coefficient KAF, and the final fuel injection amount TOUT is calculated by subjecting this requested injection amount TCYL to a correction process and an adhesion correction process in accordance with a battery voltage.

Next, the process proceeds to Step 24, in which an injection timing θINJ is calculated in accordance with the engine rotational speed NE and the final fuel injection amount TOUT. Then, this process is finished. When the final fuel injection amount TOUT and the injection timing θINJ are calculated as described above, a control input signal corresponding to the final fuel injection amount TOUT and the injection timing θINJ is supplied to the port fuel injection valves 11. This causes fuel to be injected from the port fuel injection valves 11 to the air-intake ports 5*a*.

Returning to FIG. 2, after the PI control process is executed in Step 4 as described above, this process is finished.

Meanwhile, in a case where the result of the determination in Step 3 is NO, that is, in a case where F_PI=F_DI=1, the process proceeds to Step 5, in which the PI+DI control process is executed. This PI+DI control process, the content of which is not shown, is executed as described below.

Specifically, after the final fuel injection amount TOUT is calculated by a similar manner to that of FIG. 5, the final fuel injection amount TOUT is divided in accordance with a driving state of the engine 3 so as to calculate fuel injection amounts for the two fuel injection valves 11 and 21. Then, injection timings for the two fuel injection valves 11 and 21 are calculated in accordance with these fuel injection amounts and the engine rotational speed NE. Then, a control input signal corresponding to the calculated fuel injection amounts and injection timings is supplied to the two fuel injection valves 11 and 21. This causes fuel to be injected from the port fuel injection valves 11 into the air-intake ports 5*a* and from the in-cylinder fuel injection valves 21 into the cylinders 4. After the PI+DI control process is executed as described above in Step 5, this process is finished.

Meanwhile, in a case where the result of the determination in Step 2 is NO, that is, in a case where F_PI=0, the process proceeds to Step 6, in which it is determined whether or not the DI control flag F_DI is "1". In a case where the result of this determination is YES, the process proceeds to Step 7, in which the DI control process is executed. This DI control process, the content of which is not shown, is executed as described below.

Specifically, the final fuel injection amount TOUT and the injection timing θINJ are calculated in a manner similar to that of FIG. 5. Then, a control input signal corresponding to the final fuel injection amount TOUT and the injection timing θINJ is supplied to the in-cylinder fuel injection valves 21. This causes fuel to be injected from the in-cylinder fuel injection valves 21 into the cylinders 4. After the DI control process is executed in Step 7 as described above, this process is finished.

Meanwhile, in a case where the result of the determination in Step 6 is NO, that is, in a case where F_PI =F_DI=0 which indicates a driving state in which fuel injection should be stopped, the process proceeds to Step 8, in which the final fuel injection amount TOUT is set to "0", and fuel injection is stopped. Then, this process is finished.

Next, a malfunction judging process is described with reference to FIG. 6. This malfunction judging process is a process for judging malfunction of the port fuel injection valves 11 and the in-cylinder fuel injection valves 21, and is executed in a predetermined control cycle ΔT (e.g., 10 msec) by the ECU 2.

Figure 6:
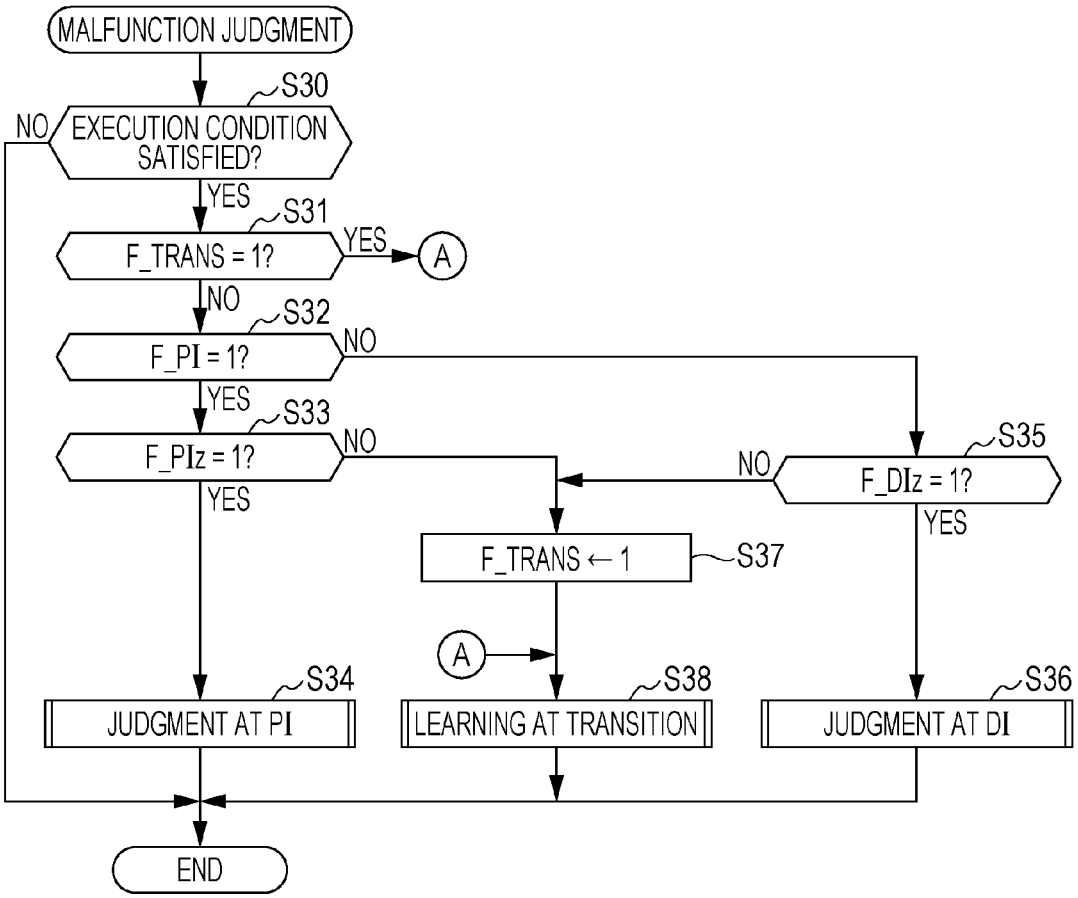
FIG. 6 is a flow chart showing a malfunction judging process.

As illustrated in FIG. 6, first, in Step 30, it is determined whether or not execution conditions for this malfunction judging process are satisfied. In this case, specifically, it is determined that the execution conditions for this malfunction judging process are satisfied, in a case where all of the following three conditions (f1) to (f3) are satisfied. In the other cases, it is determined that the execution conditions for this malfunction judging process are not satisfied.

(f1) F_NG_PI=F_NG_DI=0

(f2) F_PI≠F_DI (f3) The devices of the engine 3 are normal.

Note that the two flags F_NG_PI and FNG_DI in the condition (f1) indicate whether or not the port fuel injection valves 11 and the in-cylinder fuel injection valves 21 have malfunctioned, and values of these two flags are set as described later. In this case, F_NG_PI=F_NG_DI=0 indicates that both of the port fuel injection valves 11 and the in-cylinder fuel injection valves 21 are normal. The condition (f2) indicates that the PI control process is being executed or that the DI control process is being executed.

In a case where the result of the determination in Step 30 is NO, that is, in a case where the execution conditions for this malfunction judging process are not satisfied, this process is finished.

Meanwhile, in a case where the result of the determination in Step 30 is YES, that is, in a case where the execution conditions for this malfunction judging process are satisfied, the process proceeds to Step 31, in which it is determined whether or not a learning flag at transition F_TRANS is "1". This learning flag at transition F_TRANS is set to "1" when PI region transition of the driving state from a region other than the PI region to the PI region occurs or when DI region transition of the driving state from a region other than the DI region to the DI region occurs.

In a case where the result of the determination in Step 31 is NO, that is, in a case where the PI region transition does not occur or in a case where the DI region transition does not occur, the process proceed to Step 32, in which it is determined whether or not the PI control flag F_PI is "1".

In a case where the result of this determination is YES, that is, in a case where the PI control process is being executed, the process proceeds to Step 33, in which it is determined whether or not a previous value F_PIz of the PI control flag is "1". In a case where the result of this determination is YES, that is, in a case where F_PI=F_Piz=1, which indicates that the PI control process was also executed at a previous control timing, the process proceeds to Step 34, in which a judging process at PI is executed.

Figure 7:
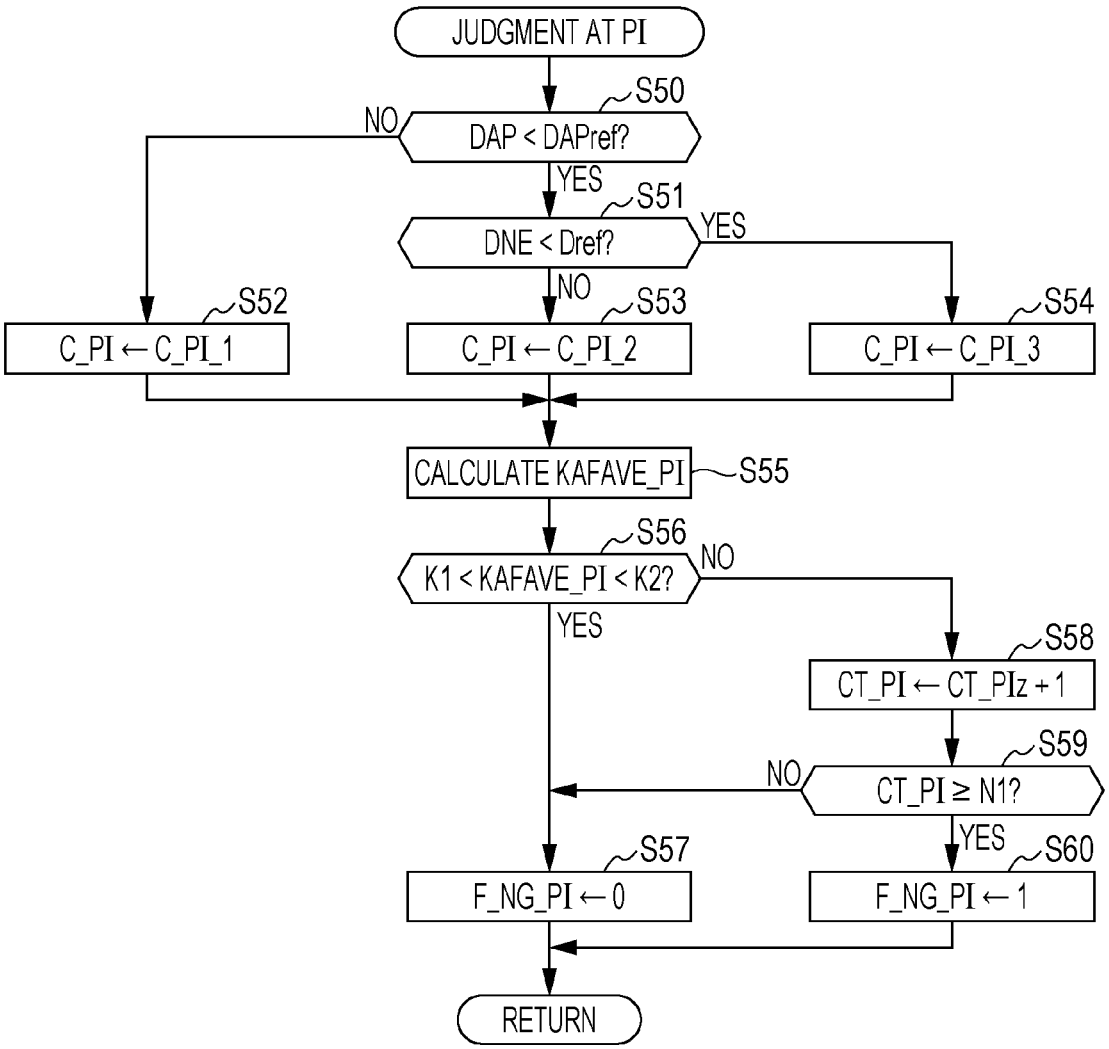
FIG. 7 is a flow chart showing a judgment process at PI.

This judging process at PI is a process of judging malfunction of the port fuel injection valves 11 during execution of the PI control process. Specifically, the judging process at PI is executed as illustrated in FIG. 7. As illustrated in FIG. 7, first, in Step 50, it is determined whether or not an accelerator position deviation DAP is smaller than a predetermined value DAPref. This accelerator position deviation DAP is calculated as an absolute value |AP-APz| of deviation of a current value and a previous value of the accelerator position AP.

In a case where the result of the determination in Step 50 is NO, that is, in a case where DAP≥DAPref is satisfied, which indicates that the amount of change of the accelerator position AP is large, it is estimated that a fluctuation of an air-fuel ratio of an air-fuel mixture is large and the air-fuel ratio is in an unstable state, and the process proceeds to Step 52, in which a weight coefficient C_PI for judgment at PI is set to a first predetermined value C_PI_1.

Meanwhile, in a case where the result of the determination in Step 50 is YES, that is, in a case where it is estimated that the air-fuel ratio of the air-fuel mixture is small and the air-fuel ratio is in a stable state, the process proceeds to Step 51, in which it is determined whether or not a rotational speed deviation DNE is smaller than a predetermined value Dref. This rotational speed deviation DNE is calculated as an absolute value |NE-NEz| of deviation of a previous value from a current value of the engine rotational speed NE. This predetermined value Dref is set to a value by which it can be determined whether or not a combustion state of the engine 3 is stable.

In a case where the result of this determination is NO, that is, in a case where DNE≥Dref is satisfied, which indicates that the amount of change of the engine rotational speed NE is large, it is estimated that the combustion state of the engine 3 is instable, and the process proceeds to Step 53, in which the weight coefficient C_PI for judgment at PI is set to a second predetermined value C_PI_2.

Meanwhile, in a case where the result of the determination in Step 51 is YES, that is, in a case where the amount of change of the engine rotational speed NE is small, it is estimated that the combustion state of the engine 3 is stable, and the process proceeds to Step 54, in which the weight coefficient C_PI for judgment at PI is set to a third predetermined value C_PI_3. In this case, for reasons described later, the three predetermined values C_PI_1, $C_PI_{13}$ 2, and C_PI_3 are set so that 0<C_PI_1<C_PI_2<C_PI_3<1 is satisfied.

In Step 55 following any of Steps 52 to 54 described above, a learned value KAFAVE_PI for judgment at PI is calculated by weighted average calculation according to the following expression (1):

$$KAFAVE_PI=C_PI\cdot KAF+(1-C_PI)\cdot KAFAVE_Piz \quad (1)$$

Note that the value KAFAVE_PIz in the expression (1) is a previous value of the learned value for judgment at PI.

As described above, the learned value KAFAVE_PI for judgment at PI is calculated by weighted average calculation of the feedback correction coefficient KAF. Therefore, the larger the weight coefficient C_PI becomes, the more speedily the feedback correction coefficient KAF is reflected in the learned value KAFAVE_PI for judgment at PI. That is, the learning speed for the learned value KAFAVE_PI for judgment at PI becomes higher. Based on this principle, when the learned value KAFAVE_PI for judgment at PI is calculated, the three predetermined values C_PI_1, C_PI_2, and C_PI_3 are set so that 0<C_PI_1<C_PI_2<C_PI_3<1 is satisfied, for the purpose of making the learning speed higher than that in an unstable state in a case where the air-fuel ratio of the air-fuel mixture is in a stable state and making the learning speed higher than that in an unstable state in a case where the combustion state of the engine 3 is stable.

Next, the process proceeds to Step 56, in which it is determined whether or not K1<KAFAVE_PI<K2 is satisfied. In this case, the two values K1 and K2 are predetermined judgment values and are set so that 0<K1<1<K2 is satisfied. In the present embodiment, the range of K1<KAFAVE_PI<K2 corresponds to a predetermined first judgment region.

In a case where the result of the determination in Step 56 is YES, that is, in a case where K1<KAFAVE_PI<K2 is satisfied, it is determined that the port fuel injection valves 11 are normal. In order to express this, the process proceeds to Step 57, in which a port fuel injection valve malfunction flag F_NG_PI is set to "0". Then, this process is finished.

Meanwhile, in a case where the result of determination in Step 56 is NO, that is, in a case where KAFAVE_PI≤K1 or K2≤KAFAVE_PI is satisfied, the process proceeds to Step 58, in which a counted value CT_PI of a counter for judgment at PI is set to CT_PIz+1, which is the sum of a previous counted value CT_PIz and 1.In this case, the previous counted value CT_PIz of the counter for judgment at PI is initially set to 0.

Next, the process proceeds to Step 59, in which it is determined whether or not the counted value CT_PI of the counter for judgment at PI is not less than a predetermined value N1. This predetermined value N1 is set to a positive integer. In a case where the result of this determination is NO, this process is finished after Step 57 is executed as described above.

Meanwhile, in a case where the result of the determination in Step 59 is YES, that is, in a case where the number of times of occurrence of a state where the result of the determination in Step 56 is NO reaches the predetermined value N1, it is determined that the port fuel injection valves 11 have malfunctioned. In order to express this, the process proceeds to Step 60, in which the port fuel injection valve malfunction flag F_NG_PI is set to "1". Then, this process is finished.

Returning to FIG. 6, after the judgment process at PI is executed in Step 34 as described above, the malfunction judging process is finished.

In a case where the result of the determination in Step 32 is NO, that is, in a case where PI control flag F_PI=0, the process proceeds to Step 35, in which it is determined whether or not a previous value F_DIz of the DI control flag is "1". In a case where the result of this determination is YES, that is, in a case where F_DI=F_DIz=1 is satisfied, which indicates that the DI control process was also executed at a previous control timing, the process proceeds to Step 36, in which a judgment process at DI is executed.

This judgment process at DI is a process of judging malfunction of the in-cylinder fuel injection valves 21 during execution of the DI control process. Specifically, the judgment process at DI is executed as illustrated in FIG. 8.

Figure 8:
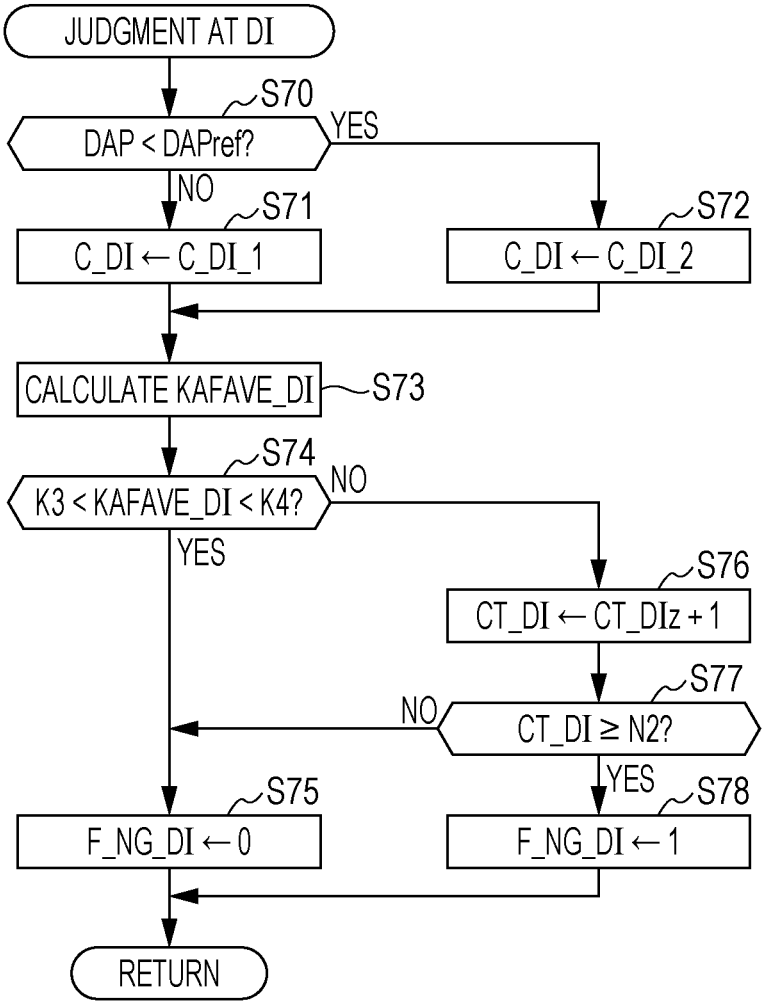
FIG. 8 is a flow chart showing a judgment process at DI.

As illustrated in FIG. 8, first, in Step 70, it is determined whether or not the accelerator position deviation DAP is smaller than a predetermined value DAPref, as in Step 50.

In a case where the result of the determination in Step 70 is NO, that is, in a case where DAP≥DAPref is satisfied, which indicates that the amount of change of the accelerator position AP is large, it is estimated that a fluctuation of the air-fuel ratio is large and the air-fuel ratio is in an unstable state, and the process proceeds to Step 71, in which a weight coefficient C_DI for judgment at DI is set to a first predetermined value C_DI_1.

Meanwhile, in a case where the result of the determination in Step 70 is YES, that is, in a case where it is estimated that a fluctuation of the air-fuel ratio is small and the air-fuel ratio is in a stable state, the process proceeds to Step 72, in which the weight coefficient CDI for judgment at DI is set to a second predetermined value C_DI_2.

In this case, the first and second predetermined values C_DI_1 and C_DI_2 are set so that 0<C_DI_1<C_DI_2<C_PI_1<C_PI_2<C_PI_3<1 is satisfied for the reasons described later.

In Step 73 following Step 71 or 72, a learned value KAFAVE_DI for judgment at DI is calculated by weighted average calculation expressed by the following expression (2):

$$KAFAVE_DI=C_DI+(1-C_DI)\cdot KAFAVE_DIz \quad (2)$$

Note that the value KAFAVE_DIz in the expression (2) is a previous value of the learned value for judgment at DI.

Figure 4:
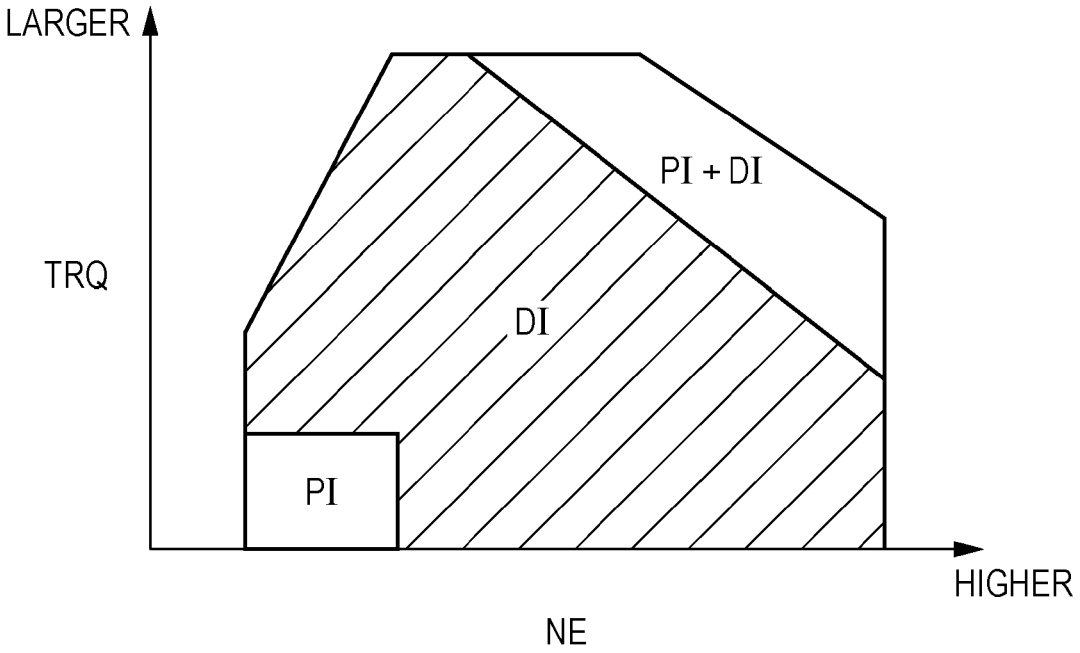
FIG. 4 is a map showing a PI region, a DI region, and a PI+DI region.

As described above, the learned value KAFAVE_DI for judgment at DI is calculated by weighted average calculation of a feedback correction coefficient KAF as with the learned value KAFAVE_PI for judgment at PI. Therefore, the larger the weight coefficient C_DI becomes, the more speedily the feedback correction coefficient KAF is reflected in the learned value KAFAVE_DI for judgment at DI. That is, learning speed for the learned value KAFAVE_DI for judgment at DI becomes higher. Based on this principle, when the learned value KAFAVE_DI for judgment at DI is calculated, the two predetermined values C_DI_1 and C_DI_2 are set so that C_DI_1<C_DI_2 is satisfied, for the purpose of making the learning speed higher than that in an unstable state in a case where the air-fuel ratio of the air-fuel mixture is in a stable state. In addition to this, since the PI region is narrower than the DI region as illustrated in FIG. 4, calculation frequency, that is, learning frequency of the learned value KAFAVE_PI for judgment at PI is smaller than that of the learned value KAFAVE_DI for judgment at DI. Therefore, in order to increase the learning speed so that the low learning frequency is compensated, the five predetermined values C_PI_1 to C_PI_3, C_DI_1, and C_DI_2 are set so that C_DI_1<C_DI_2<C_PI_1<C_PI_2<C_PI_3 is satisfied.

Next, the process proceeds to Step 74, in which it is determined whether or not K3<KAFAVE_DI<K4 is satisfied. In this case, the two values K3 and K4 are predetermined judgment values and satisfy 0<K3<1<K4. Moreover, the two values K3 and K4 are set so that K1≠K3 and K2≠K4 are satisfied in relation to the predetermined judgment values K1 and K2. In the present embodiment, the range of K3<KAFAVE_DI<K4 corresponds to a predetermined second judgment region.

In a case where the result of the determination in Step 74 is YES, it is determined that the in-cylinder fuel injection valves 21 are normal. In order to express this, the process proceeds to Step 75, in which an in-cylinder fuel injection valve malfunction flag F_NG_DI is set to "0". Then, this process is finished.

Meanwhile, in a case where the result of the determination in Step 74 is NO, that is, in a case where KAFAVE_DI≤K3 or K4≤KAFAVE_DI is satisfied, the process proceeds to Step 76, in which a counted value CT_DI of a counter for judgment at DI is set to CT_DIz+1, which is the sum of a previous value CT_DIz of the counter for judgment at DI and 1. In this case, the previous value CT_DIz of the counter for judgment at DI is initially set to "0".

Next, the process proceeds to Step 77, in which it is determined whether or not the counted value CT_DI for judgment at DI is not less than a predetermined value N2. This predetermined value N2 is set to a positive integer. In a case where the result of this determination is NO, this process is finished after Step 75 is executed as descried above.

Meanwhile, in a case where the result of the determination in Step 77 is YES, that is, in a case where the number of times of occurrence of a state where the result of the determination in Step 74 is NO reaches a predetermined value N2, it is determined that the in-cylinder fuel injection valves 21 have malfunctioned. In order to express this, the process proceeds to Step 78, in which the in-cylinder fuel injection valve malfunction flag F_NG_DI is set to "1". Then, this process is finished.

Returning to FIG. 6, the malfunction judging process is finished after the judgment process at DI is executed in Step 36 as described above.

Meanwhile, in a case where the result of the determination in Step 33 or 35 is NO, that is, in a case where F_PI=1 & F_Piz=0 is satisfied, which indicates that the PI region transition of the driving region from a region other than the PI region to the PI region occurs and the PI control process starts at this control timing or in a case where F_DI=1 & F_DIz=0 is satisfied, which indicates that the DI region transition of the driving region from a region other than the DI region to the DI region occurs and the DI control process starts at this control timing, it is determined that a learning process at transition should be executed. In order to express this, the process proceeds to Step 37, in which a learning flag at transition F_TRANS is set to "1". Then, the process proceeds to Step 38 that is described later.

As described above, in a case where the learning flag at transition F_TRANS is set to "1" in Step 37, the result of the determination in Step 31 is YES, and also in this case, the process proceeds to Step 38.

Figure 9:
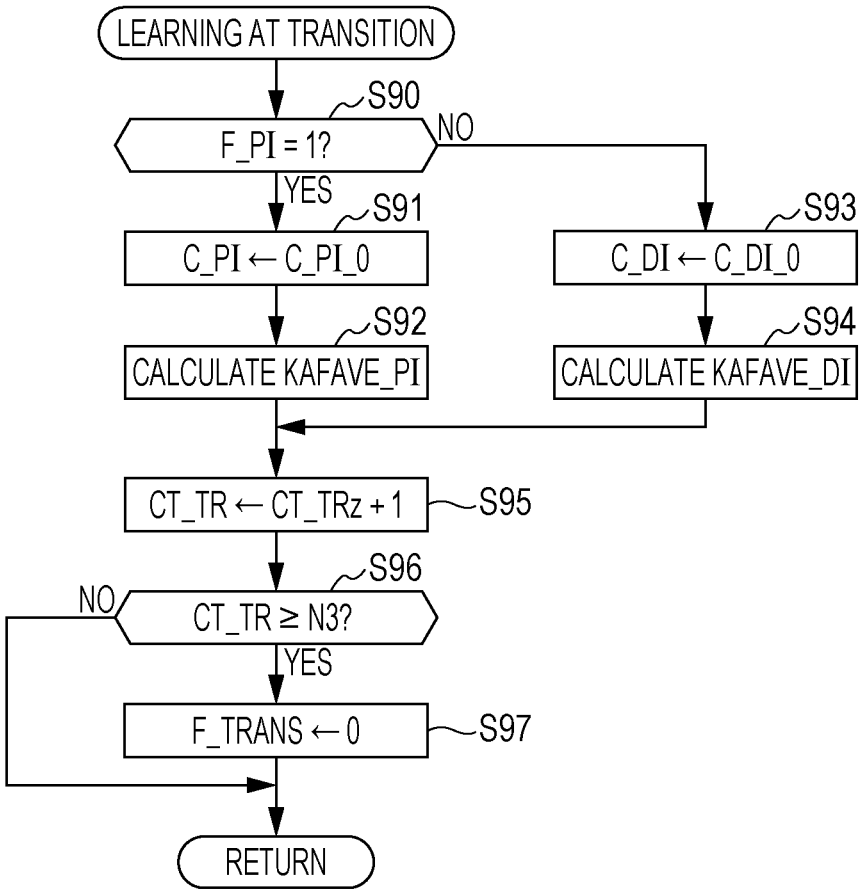
FIG. 9 is a flow chart showing a learning process at transition.

In Step 38 following Step 31 or 37, the learning step at transition is executed. This learning step at transition is specifically executed as illustrated in FIG. 9. As illustrated in FIG. 9, first, in Step 90, it is determined whether or not a PI control flag F_PI is "1".

In a case where the result of this determination is YES, that is, in a case where the PI region transition has occurred, the process proceeds to Step 91, in which the weight coefficient C_PI for judgment at PI is set to a predetermined value for transition C_PI_0. This predetermined value for transition C_PI_0 is set so that 0<C_PI_0<C_PI_1 is satisfied for the reasons described later.

Next, the process proceeds to Step 92, in which the learned value KAFAVE_PI for judgment at PI is calculated by the weighted average calculation expressed by the expression (1).

Meanwhile, in a case where the result of the determination in Step 90 is NO, that is, in a case where the DI region transition has occurred, the process proceeds to Step 93, in which the weight coefficient C_DI for judgment at DI is set to a predetermined value for transition C_DI_0.

This predetermined value for transition C_DI_0 is set so that 0<C_DI_0<C_DI_1 is satisfied for the reasons described later.

Next, the process proceeds to Step 94, in which the learned value KAFAVE_DI for judgment at DI is calculated by the weighted average calculation expressed by the expression (2).

In Step 95 following Step 92 or 94, a counted value CT_TR of a counter for learning at transition is set to CT_TRz+1, which is the sum of a previous value CT_TRz of the counter for learning at transition and 1. In this case, the previous value CT_TRz of the counter for learning at transition is initially set to "0".

Next, the process proceeds to Step 96, in which it is determined whether or not the counted value CT_TR of the counter for learning at transition is not less than a predetermined judgment value N3. In a case where the result of this determination is NO, this process is finished.

Meanwhile, in a case where the result of the determination in Step 96 is YES, that is, in a case where a time that corresponds to a value ΔT·N3 has elapsed from a start timing of the learning at transition process, it is estimated that a fluctuation of the detected air-fuel ratio KACT that occurs due to the transition of the driving region has converged, and it is thus determined that the learning at transition process should be finished. In order to express this, the process proceeds to Step 97, in which the learning flag at transition F_TRANS is set to "0". Then, this process is finished.

Returning to FIG. 6, after the learning process at transition is executed in Step 38 as described above, the malfunction judging process is finished.

As described above, according to the malfunction judging apparatus 1 of the present embodiment, in a case where a combination of the requested torque TRQ and the engine rotational speed NE is in the PI region and fuel injection using only the port fuel injection valves 11 is being executed, the learned value KAFAVE_PI for judgment at PI is calculated by applying the weighted average calculation of the expression (1) to the feedback correction coefficient KAF, whereas in a case where the combination of the requested torque TRQ and the engine rotational speed NE is in the DI region and fuel injection using only the in-cylinder fuel injection valves 21 is being executed, the learned value KAFAVE_DI for judgment at DI is calculated by applying the weighted average calculation of the expression (2) to the feedback correction coefficient KAF.

Then, malfunction of the port fuel injection valves 11 is judged on the basis of whether or not the learned value KAFAVE PI for judgment at PI calculated when the fuel injection using only the port fuel injection valves 11 is being executed is within a predetermined first judgment region (K1<KAFAVE_PI<K2). Furthermore, malfunction of the in-cylinder fuel injection valves 21 is judged on the basis of whether or not the learned value KAFAVE_DI for judgment at DI calculated when the fuel injection using only the in-cylinder fuel injection valves 21 is being executed is within a predetermined second judgment region (K3<KAFAVE_DI<K4). Therefore, it is possible to accurately judge malfunction of the port fuel injection valves 11 and the in-cylinder fuel injection valves 21 without keeping the engine 3 at a constant driving state, unlike the control method described in Japanese Unexamined Patent Application Publication No. 2009-30615.

Furthermore, since the PI region is narrower than the DI region as illustrated in FIG. 4, the calculation frequency of the learned value KAFAVE_PI for judgment at PI is lower than that of the learned value KAFAVE_DI for judgment at DI during running of the engine 3. Meanwhile, as described above, the three predetermined values C_PI_1 to C_PI_3 in the weight coefficient CPI for judgment at PI and the two predetermined values C_DI_1 and C_DI_2 in the weight coefficient C_DI for judgment at DI are set so that C_DI_1<C_DI_2<C_PI_1<C_PI_2<C_PI_3 is satisfied. Therefore, the speed at which the feedback correction coefficient KAF is reflected in the learned value KAFAVE_PI for judgment at PI is higher than the speed at which the feedback correction coefficient KAF is reflected in the learned value KAFAVE_DI for judgment at DI. That is, since the learning speed for the learned value KAFAVE_PI for judgment at PI is higher than that of the learned value KAFAVE_DI for judgment at DI, a calculation result of the feedback correction coefficient KAF is more speedily reflected in the learned value KAFAVE_PI for judgment at PI. It is therefore possible to improve the learning accuracy of the learned value KAFAVE_PI for judgment at PI.

Furthermore, when calculating the learned value KAFAVE_PI for judgment at PI, the weight coefficient C_PI for judgment at PI is, in a case where DAP≤DAPref is satisfied, a fluctuation of the air-fuel ratio of the air-fuel mixture is large, and the air-fuel ratio of the air-fuel mixture is in an unstable state in Steps 50 to 54, set to the first predetermined value C_PI_1 that is smaller than the second and third predetermined values C_PI_2 and C_PI_3 which are set in a case where it is estimated that the air-fuel ratio is in a stable state. This makes it possible to learn the learned value KAFAVE_PI for judgment at PI while suppressing a fluctuation of the feedback correction coefficient KAF and the influence of a calculation error that occur due to the fluctuation of the air-fuel ratio of the air-fuel mixture. It is therefore possible to suppress a decrease in learning accuracy of the learned value KAFAVE_PI for judgment at PI.

In addition to this, in a case where DNE<Dref is satisfied and it is estimated that the combustion state of the engine 3 is stable, the weight coefficient C_PI for judgment at PI is set to C_PI_3 that is larger than the second predetermined value C_PI_2 which is set in a case where it is estimated that the combustion state of the engine 3 is unstable. Therefore, the feedback correction coefficient KAF that is accurately calculated because of the stable combustion state of the engine 3 can be more speedily reflected in the learned value. It is therefore possible to further improve the learning accuracy of the learned value.

When calculating the learned value KAFAVE_DI for judgment at DI, the weight coefficient C_DI for judgment at DI is, in a case where DAP≤DAPref is satisfied, a fluctuation of the air-fuel ratio of the air-fuel mixture is large, and the air-fuel ratio of the air-fuel mixture is in an unstable state in Steps 70 to 72, set to the first predetermined value C_DI_1 that is smaller than the second predetermined value C_DI_2 which is set in a case where it is estimated that the air-fuel ratio of the air-fuel mixture is in a stable state.

This makes it possible to learn the learned value KAFAVE_DI for judgment at DI while suppressing a fluctuation of the feedback correction coefficient KAF and the influence of a calculation error that occur due to the fluctuation of the air-fuel ratio of the air-fuel mixture. It is therefore possible to suppress a decrease in the learning accuracy of the learned value KAFAVE_DI for judgment at DI.

Furthermore, in a case where the PI region transition has occurred, in the learning process at transition, the weight coefficient CPI for judgment at PI is set to C_PI_0 (<C_PI_1) that is smaller than that set in a case where the PI region transition does not occur. This makes it possible to learn the learned value KAFAVE_PI for judgment at PI while suppressing a fluctuation of the feedback correction coefficient KAF and the influence of a calculation error that occur due to occurrence of the PI region transition. Similarly, in a case where the DI region transition has occurred, in the learning process at transition, the weight coefficient C_DI for judgment at DI is set to C_DI_0 (<C_DI_1) that is smaller than that set in a case where the DI region transition does not occur. This makes it possible to learn the learned value KAFAVE_DI for judgment at DI while suppressing a fluctuation of the feedback correction coefficient KAF and the influence of a calculation error that occur due to occurrence of the DI region transition.

In addition to this, upper and lower limit values K1 and K2 that define the first judgment region of the learned value KAFAVE_PI for judgment at PI and upper and lower limit values K3 and K4 that define the second judgment region of the learned value KAFAVE_DI for judgment at DI are set so that K1≠K3 and K2≠K4 are satisfied. Therefore, by setting these four values K1 to K4 to values suitable for characteristics of the PI region and the DI region, malfunction judgment can be accurately executed. For the above reasons, the accuracy of judgment of malfunction of the port fuel injection valves 11 and the in-cylinder fuel injection valves 21 can be further improved.

In the embodiment, an example in which the detected air-fuel ratio KACT is used as an air-fuel ratio parameter has been described. However, the air-fuel ratio parameter of the present disclosure is not limited to this, provided that the air-fuel ratio parameter represents an air-fuel ratio of an exhaust gas flowing through the exhaust path. For example, an air excess ratio or a fuel-air ratio may be used as the air-fuel ratio parameter.

In the embodiment, an example in which the engine rotational speed NE and the requested torque TRQ are used as a load parameter has been described. However, the load parameter of the present disclosure is not limited to these, provided that the load parameter represents a load of the internal-combustion engine. For example, an inhaled air amount, the accelerator position AP, and the like may be used as the load parameter.

In the embodiment, an example in which the learning process at transition is executed in a case where the PI region transition, which is transition from a region other than the PI region to the PI region, occurs or in a case where the DI region transition, which is transition from a region other than the DI region to the DI region, occurs has been described. However, such an arrangement is also possible in which in a case where such region transition occurs, the learning process at transition is stopped by setting both of the two values for transition C_PI_0 and C_DI_0 to 0.

According to this arrangement, it is possible to learn the two learned values KAFAVE_PI and KAFAVE_DI only under such a condition that the fluctuation of the feedback correction coefficient KAF and the calculation error are unlikely to occur while avoiding the fluctuation of the feedback correction coefficient KAF and the influence of the calculation error that occur due to occurrence of region transition although the learning speed for the two learned values KAFAVE_PI and KAFAVE_DI decreases. It is therefore possible to maintain the learning accuracy of the two learned values KAFAVE_PI and KAFAVE_DI at a good level.

Meanwhile, in the embodiment, an example in which the three predetermined values C_PI_1 to C_PI_3 in the weight coefficient C_PI for judgment at PI and the two predetermined values C_DI_1 and C_DI_2 in the weight coefficient C_DI for judgment at DI are set so that C_DI_1<C_DI_2<C_PI_1<C_PI_2<C_PI_3 is satisfied has been described. However, the present disclosure is not limited to this, provided that these predetermined values are set so that the learning speed for the learned value KAFAVE_PI for judgment at PI becomes higher than the learning speed for the learned value KAFAVE_DI for judgment at DI. For example, these predetermined values may be set so that at least C_DI_1<C_PI_1 and C_DI_2<C_PI_2 are satisfied or these predetermined values may be set so that C_DI_1<C_PI_1<C_DI_2<C_PI_2 is satisfied.

In the embodiment, an example in which the learning speed for the learned value KAFAVE_PI for judgment at PI, which is the first learned value, is made higher than that of the learned value KAFAVE_DI for judgment at DI, which is the second learned value, by setting weight coefficients of weighted average calculation to different values has been described. Instead of this, such an arrangement is also possible in which the learning speed for the first learned value is made higher than that of the second learned value by reducing the cycle of execution of the weighted average calculation.

In the embodiment, an example in which a method of comparing the rotational speed deviation DNE with the predetermined value Dref is used as a combustion state judging method for determining whether or not the combustion state of the internal-combustion engine is stable has been described. However, the combustion state judging method of the present disclosure is not limited to this, provided that the combustion state judging method is one that makes it possible to determine whether or not the combustion state of the internal-combustion engine is stable. For example, a method of determining whether or not the internal-combustion engine is idling, a method of comparing the amount of fluctuation of the requested torque TRQ with a predetermined value, or a method of comparing the amount of change of vehicle speed with a predetermined value may be used as the combustion state judging method. Furthermore, a combination of these methods and the method of using rotational speed deviation may be used.

Meanwhile, such an arrangement is also possible in which in the judgment process at DI of FIG. 8, it is determined whether or not the rotational speed deviation DNE is smaller than the predetermined value Dref, and the weight coefficient C_DI for judgment at DI is set to different values on the basis of the result of the determination. Furthermore, in FIG. 4, the DI region may be set to be larger than the PI region. In this case, the weight coefficient C_DI for judgment at DI is set to a value larger than the weight coefficient C_PI for judgment at PI.

In the embodiment, an example in which a method of comparing the accelerator position deviation DAP with the predetermined value DAPref is used as an air-fuel ratio state judging method for determining whether or not the air-fuel ratio of the air-fuel mixture of the internal-combustion engine is in an unstable state has been described. However, the air-fuel ratio state judging method of the present disclosure is not limited to this, provided that the air-fuel ratio state judging method is one that makes it possible to determine whether or not the air-fuel ratio of the air-fuel mixture of the internal-combustion engine is in an unstable state. For example, a method of calculating the amount of change of the detected air-fuel ratio KACT on the basis of a detection signal of the LAF sensor 32 and comparing this with a predetermined value may be used as the air-fuel ratio state judging method.

In the embodiment, an example in which, in a case where DAP≤DAPref is satisfied and the air-fuel ratio of the air-fuel mixture of the internal-combustion engine is in an unstable state, the learning speed for the two learned values KAFAVE_PI and KAFAVE_DI is set to a value that is smaller than that in a case where the air-fuel ratio is in a stable state has been described. However, one of the two learned values KAFAVE_PI and KAFAVE_DI may be set so as to be smaller than that in the stable state. In addition to this, such an arrangement is also possible in which in a case where the air-fuel ratio of the air-fuel mixture of the internal-combustion engine is in an unstable state, learning of at least one of the two learned values KAFAVE_PI and KAFAVE_DI is stopped by setting at least one of the two weight coefficients C_PI and C_DI to 0.

Meanwhile, in the embodiment, an example in which the malfunction judging apparatus of the present disclosure is applied to a fuel feeding apparatus in an internal-combustion engine for vehicles has been described. However, the malfunction judging apparatus of the present disclosure is not limited to this. The malfunction judging apparatus of the present disclosure can be applied to one that includes a first fuel feeding apparatus and a second fuel feeding apparatus that feed fuel into an air intake path and a cylinder, respectively. For example, the malfunction judging apparatus of the present application may be applied to a fuel feeding apparatus in an internal-combustion engine for ships or a fuel feeding apparatus in an internal-combustion engine for other industrial apparatuses.

A first aspect of the present disclosure is a malfunction judging apparatus for a fuel feeding apparatus that judges malfunction of a first fuel feeding apparatus and a second fuel feeding apparatus which feed fuel into an air intake path and a cylinder of an internal-combustion engine, respectively, including: an air-fuel ratio parameter detecting unit (an ECU, an LAF sensor) that detects an air-fuel ratio parameter (a detected air-fuel ratio KACT) which represents an air-fuel ratio of an exhaust gas flowing through an exhaust path of the internal-combustion engine; a load parameter detecting unit (the ECU, a crank angle sensor, an accelerator position sensor) that detects a load parameter (engine rotational speed NE, requested torque TRQ) which represents a load of the internal-combustion engine; a feedback correction value calculating unit (the ECU, Step 22) that calculates a feedback correction value (a feedback correction coefficient KAF) by using the detected air-fuel ratio parameter and a predetermined feedback control algorithm; a fuel control unit (the ECU, Steps 4, 5, 7, and 8) that controls the amount of fuel fed by the first fuel feeding apparatus and the second fuel feeding apparatus by using the calculated feedback correction value; a region judging unit (the ECU, Steps 11 to 17) that determines which of a first region (a PI region), in which only the first fuel feeding apparatus should be used, a second region (a DI region), in which only the second fuel feeding apparatus should be used, and a region other than the first region and the second region, the detected load parameter is in; and a malfunction judging unit (the ECU, Steps 55 to 60 and 73 to 78) that, on the basis of a result of the determination of the region judging unit, (i) learns, as a first learned value (a learned value KAFAVE_PI for judgment at PI), a feedback correction value calculated in a case where the load parameter is in the first region by using a predetermined first learning method (expression (1), (ii) learns, as a second learned value (a learned value KAFAVE_DI for judgment at DI), a feedback correction value calculated in a case where the load parameter is in the second region by using a predetermined second learning method (expression 2), (iii) judges malfunction of the first fuel feeding apparatus on the basis of the first learned value, and (iv) judges malfunction of the second fuel feeding apparatus on the basis of the second learned value, the malfunction judging unit judging malfunction of the first fuel feeding apparatus and malfunction of the second fuel feeding apparatus by using different methods.

According to this malfunction judging apparatus for a fuel feeding apparatus, it is determined which of a first region, in which only the first fuel feeding apparatus should be used, a second region, in which only the second fuel feeding apparatus should be used, and a third region other than the first region and the second region, the detected load parameter is in. Then, on the basis of the result of this determination, a feedback correction value calculated in a case where the load parameter is in the first region is learned as a first learned value by using a predetermined first learning method, and a feedback correction value calculated in a case where the load parameter is in the second region is learned as a second learned value by using a predetermined second learning method. Furthermore, malfunction of the first fuel feeding apparatus is judged on the basis of the learned first learned value, and malfunction of the second fuel feeding apparatus is judged on the basis of the learned second learned value. It is therefore possible to judge malfunction of the first and second fuel feeding apparatuses without maintaining the internal-combustion engine at a constant driving state. In addition to this, malfunction of the first fuel feeding apparatus and malfunction of the second fuel feeding apparatus are judged by using different methods. Therefore, malfunction judgment can be executed by using methods suitable for characteristics of the first and second regions in which the first and second learned values are learned. For the above reasons, malfunction of the first and second fuel feeding apparatuses can be accurately and speedily judged. This makes it possible to improve merchantability (Note that "detection" used herein such as "detection of a load parameter" and "detection of an air-fuel ratio parameter" is not limited to direct detection of these parameters by a sensor or the like and encompasses calculation of these parameters by using other parameters.)

In the malfunction judging apparatus according to the first aspect of the present disclosure, the second aspect of the present disclosure may be arranged such that one (the PI region) of the first-region and the second region is narrower than the other one (the DI region) of the first region and the second region (FIG. 4); and the malfunction judging unit sets learning speed for one of the first learned value and the second learned value which are learned in a case where the detected load parameter is in the one of the first region and the second region to a value that is larger than that of the other one of the first learned value and the second learned value (Steps 52 to 54, 72, and 72).

According to the malfunction judging apparatus for a fuel feeding apparatus, one of the first region and the second region is narrower than the other one of the first region and the second region. Therefore, the learning frequency of a learned value learned in the one of the first region and the second region is lower than that of a learned value learned in the other one of the first region and the second region. Meanwhile, since learning speed for one of the first learned value and the second learned value calculated in the one of the first region and the second region is set to a value that is larger than the learning speed in the other one of the first learned value and the second learned value, learning speed for a learned value whose learning frequency is lower becomes higher. This makes it possible to more speedily reflect a calculation result of the feedback correction value in the learned value. It is therefore possible to improve learning accuracy of the learned value.

In the malfunction judging apparatus according to the second aspect of the present disclosure, a third aspect of the present disclosure may be arranged to further include a combustion state judging unit (the ECU, Step 51) that determines whether or not a combustion state of the internal-combustion engine is stable, in a case where it is determined, as a result of the determination by the combustion state judging unit, that the combustion state of the internal-combustion engine is stable, the malfunction judging unit setting, the learning speed for the one of the first learned value and the second learned value to a value that is larger than that in a case where the combustion state of the internal-combustion engine is unstable (Steps 53 and 54).

According to the malfunction judging apparatus for a fuel feeding apparatus, in a case where a combustion state of the internal-combustion engine is stable, the learning speed for the one of the first learned value and the second learned value is set to a value larger than that in a case where the combustion state of the internal-combustion engine is unstable. Therefore, a feedback correction value that is accurately calculated because of the stable combustion state of the internal-combustion engine can be more speedily reflected in the learned value. It is therefore possible to further improve learning accuracy of the learned value.

In the malfunction judging apparatus according to any one of the first through third aspects of the present disclosure, a fourth aspect of the present disclosure may be arranged such to further include a region transition judging unit (the ECU, Steps 33 and 35) that determines whether or not one of first region transition and second region transition has occurred, the first region transition being transition of the region of the load parameter from a region other than the first region to the first region and the second region transition being transition of the region of the load parameter from a region other than the second region to the second region, in a case where it is determined, as a result of the determination by the region transition judging unit, that the one of the first region transition and the second region transition has occurred, the malfunction judging unit setting learning speed for one of the first learned value and the second learned value which are calculated in a case where the load parameter is in the region after the region transition to a value smaller than that in a case where the one of the first region transition and the second region transition does not occur or stops learning of the one of the first learned value and the second learned value (Steps 91 to 94).

According to the malfunction judging apparatus for a fuel feeding apparatus, it is determined whether or not one of first region transition of the region of the load parameter from a region other than the first region to the first region and second region transition of the region of the load parameter from a region other than the first region to the second region has occurred. In a case where it is determined that the one of the first region transition and the second region transition has occurred, learning speed for one of the first learned value and the second learned value calculated in a case where the load parameter is in the region after the region transition is set to a value smaller than that in a case where the one of the first region transition and the second region transition does not occur or learning of the one of the first learned value and the second learned value is stopped. Therefore, in a case where the learning speed for the one of the first learned value and the second learned value is set to be small, the one of the first learned value and the second learned value can be learned while suppressing a fluctuation of the feedback correction value and the influence of a calculation error that occur due to region transition of the load parameter. It is therefore possible to suppress a decrease in learning accuracy. Furthermore, in a case where learning of the one of the first learned value and the second learned value is stopped, the one of the first learned value and the second learned value can be learned while avoiding a fluctuation of the feedback correction value and the influence of a calculation error that occur due to region transition of the load parameter. Therefore, learning accuracy can be maintained at a good level.

In the malfunction judging apparatus according to any one of the first through fourth aspects of the present disclosure, a fifth aspect of the present disclosure may be arranged to further include an air-fuel ratio state judging unit (the ECU, Steps 50 and 70) that determines whether or not an air-fuel ratio of an air-fuel mixture of the internal-combustion engine is in an unstable state, in a case where it is determined, as a result of the determination by the air-fuel ratio state judging unit, that the air-fuel ratio of the air-fuel mixture is in the unstable state, the malfunction judging unit setting learning speed for at least one of the first learned value and the second learned value to a value smaller than that in a case where the air-fuel ratio of the air-fuel mixture is in a stable state or stopping learning of the at least one of the first learned value and the second learned value (Steps 50, 52, 53, and 70 to 72).

According to the malfunction judging apparatus for a fuel feeding apparatus, in a case where the air-fuel ratio of the air-fuel mixture is in the unstable state, learning speed for at least one of the first learned value and the second learned value is set to a value smaller than that in a case where the air-fuel ratio of the air-fuel mixture is in a stable state or learning of the at least one of the first learned value and the second learned value is stopped. Therefore, in a case where the learning speed for the one of the first learned value and the second learned value is set to be small, the at least one of the first learned value and the second learned value can be learned while suppressing a fluctuation of the feedback correction value and the influence of a calculation error that occur due to the fluctuation of the air-fuel ratio of the air-fuel mixture. It is therefore possible to suppress a decrease in learning accuracy. Furthermore, in a case where learning of the one of the first learned value and the second learned value is stopped, the one of the first learned value and the second learned value can be learned while avoiding a fluctuation of the feedback correction value and the influence of a calculation error that occur due to the fluctuation of the air-fuel ratio of the air-fuel mixture. Therefore, learning accuracy can be maintained at a good level.

In the malfunction judging apparatus according to any one of the first through fifth aspects of the present disclosure, a sixth aspect of the present disclosure may be arranged such that the malfunction judging unit judges malfunction of the first fuel feeding apparatus on the basis of whether or not the first learned value is in a predetermined first judgment region (Step 56), and judges malfunction of the second fuel feeding apparatus on the basis of whether or not the second learned value is in a predetermined second judgment region that is different from the predetermined first judgment region (Step 74).

According to the malfunction judging apparatus for a fuel feeding apparatus, malfunction of the first fuel feeding apparatus is judged on the basis of whether or not the first learned value is in a predetermined first judgment region, and malfunction of the second fuel feeding apparatus is judged on the basis of whether or not the second learned value is in a predetermined second judgment region different from the predetermined first judgment region. Therefore, by appropriately setting the first judgment region and the second judgment region, the accuracy of judgment of malfunction can be improved.

Obviously, numerous modifications and variations of the present invention are possible in light of the above teachings. It is therefore to be understood that within the scope of the appended claims, the invention may be practiced otherwise than as specifically described herein.

What is claimed is:

1. A malfunction judging apparatus for a fuel feeding apparatus that judges malfunction of a first fuel feeding apparatus and a second fuel feeding apparatus which feed fuel into an air intake path and a cylinder of an internal-combustion engine, respectively, comprising:

an air-fuel ratio parameter detecting unit that detects an air-fuel ratio parameter which represents an air-fuel ratio of an exhaust gas flowing through an exhaust path of the internal-combustion engine;

a load parameter detecting unit that detects a load parameter which represents a load of the internal-combustion engine;

a feedback correction value calculating unit that calculates a feedback correction value by using the detected air-fuel ratio parameter and a predetermined feedback control algorithm;

a fuel control unit that controls the amount of fuel fed through the first fuel feeding apparatus and the second fuel feeding apparatus by using the calculated feedback correction value;

a region judging unit that determines which of a first region, in which only the first fuel feeding apparatus should be used, a second region, in which only the second fuel feeding apparatus should be used, and a region other than the first region and the second region, the detected load parameter is in; and a malfunction judging unit that, on the basis of a result of the determination of the region judging unit, (i) learns, as a first learned value, a feedback correction value calculated in a case where the load parameter is in the first region by using a predetermined first learning method, (ii) learns, as a second learned value, a feedback correction value calculated in a case where the load parameter is in the second region by using a predetermined second learning method, (iii) judges malfunction of the first fuel feeding apparatus on the basis of the first learned value, and (iv) judges malfunction of the second fuel feeding apparatus on the basis of the second learned value, the malfunction judging unit judging malfunction of the first fuel feeding apparatus and malfunction of the second fuel feeding apparatus by using different methods.

2. The malfunction judging apparatus according to claim 1, wherein:

one of the first region and the second region is narrower than the other one of the first region and the second region; and the malfunction judging unit sets a learning speed for one of the first learned value and the second learned value which are learned in a case where the detected load parameter is in the one of the first region and the second region to a value that is larger than that of the other one of the first learned value and the second learned value.

3. The malfunction judging apparatus according to claim 2, further comprising a combustion state judging unit that determines whether or not a combustion state of the internal-combustion engine is stable, in a case where it is determined, as a result of the determination by the combustion state judging unit, that the combustion state of the internal-combustion engine is stable, the malfunction judging unit setting, the learning speed for the one of the first learned value and the second learned value to a value that is larger than that in a case where the combustion state of the internal-combustion engine is unstable.

4. The malfunction judging apparatus according to claim 1, further comprising a region transition judging unit that determines whether or not one of first region transition and second region transition has occurred, the first region transition being transition of the region of the load parameter from a region other than the first region to the first region and the second region transition being transition of the region of the load parameter from a region other than the second region to the second region, in a case where it is determined, as a result of the determination by the region transition judging unit, that one of the first region transition and the second region transition has occurred, the malfunction judging unit setting a learning speed for one of the first learned value and the second learned value which are calculated in a case where the load parameter is in the region after the region transition to a value smaller than that in a case where the one of the first region transition and the second region transition does not occur or stops learning of the one of the first learned value and the second learned value.

5. The malfunction judging apparatus according to claim 1, further comprising an air-fuel ratio state judging unit that determines whether or not an air-fuel ratio of an air-fuel mixture of the internal-combustion engine is in an unstable state, in a case where it is determined, as a result of the determination by the air-fuel ratio state judging unit, that the air-fuel ratio of the air-fuel mixture is in the unstable state, the malfunction judging unit setting a learning speed for at least one of the first learned value and the second learned value to a value smaller than that in a case where the air-fuel ratio of the air-fuel mixture is in a stable state or stopping learning of the at least one of the first learned value and the second learned value.

6. The malfunction judging apparatus according to claim 1, wherein the malfunction judging unit judges malfunction of the first fuel feeding apparatus on the basis of whether or not the first learned value is in a predetermined first judgment region, and judges malfunction of the second fuel feeding apparatus on the basis of whether or not the second learned value is in a predetermined second judgment region that is different from the predetermined first judgment region.

7. A malfunction judging method for a fuel feeding apparatus in an internal-combustion engine, the method comprising:

detecting an air-fuel ratio parameter which represents an air-fuel ratio of an exhaust gas flowing through an exhaust path of the internal-combustion engine;

detecting a load parameter which represents a load of the internal-combustion engine;

calculating a feedback correction value based on the air-fuel ratio parameter and a predetermined feedback control algorithm;

controlling a first amount of fuel fed through a first fuel feeding apparatus into an air intake path based on the feedback correction value;

controlling a second amount of fuel fed through a second fuel feeding apparatus into a cylinder of the internal-combustion engine based on the feedback correction value;

determining in which region the load parameter exists among a first region in which only the first fuel feeding apparatus is used, a second region in which only the second fuel feeding apparatus is used, and a third region other than the first region and the second region;

determining the feedback correction value calculated in a case where the load parameter exists in the first region as a first learned value using a predetermined first learning method;

determining the feedback correction value calculated in a case where the load parameter exists in the second region as a second learned value using a predetermined second learning method;

judging malfunction of the first fuel feeding apparatus based on the first learned value using a first judging method; and judging malfunction of the second fuel feeding apparatus based on the second learned value using a second judging method different from the first method.

8. The malfunction judging method according to claim 7, wherein one of the first region and the second region is narrower than another one of the first region and the second region, and the malfunction judging method comprises setting a learning speed for one of the first learned value and the second learned value which are determined in a case where the load parameter exists in the one of the first region and the second region to a value larger than the learning speed for another one of the first learned value and the second learned value.

9. The malfunction judging method according to claim 8, further comprising:

determining whether or not a combustion state of the internal-combustion engine is stable; and in a case where the combustion state of the internal-combustion engine is stable, setting the learning speed for the one of the first learned value and the second learned value to a value larger than the learning speed in a case where the combustion state of the internal-combustion engine is unstable.

10. The malfunction judging method according to claim 7, further comprising:

determining whether or not one of first region transition and second region transition has occurred, the first region transition comprising transition of a region of the load parameter from a region other than the first region to the first region and the second region transition comprising transition of the region of the load parameter from a region other than the second region to the second region; and in a case where one of the first region transition and the second region transition has occurred, setting a learning speed for one of the first learned value and the second learned value which are determined in a case where the load parameter exists in a region after a region transition to a value smaller than the learning speed in a case where the one of the first region transition and the second region transition does not occur or stopping determining of the one of the first learned value and the second learned value.

11. The malfunction judging method according to claim 7, further comprising:

determining whether or not an air-fuel ratio of an air-fuel mixture of the internal-combustion engine is in an unstable state; and in a case where the air-fuel ratio of the air-fuel mixture is in the unstable state, setting a learning speed for at least one of the first learned value and the second learned value to a value smaller than the learning speed in a case where the air-fuel ratio of the air-fuel mixture is in a stable state or stopping determining of the at least one of the first learned value and the second learned value.

12. The malfunction judging method according to claim 7, further comprising:

judging malfunction of the first fuel feeding apparatus based on whether or not the first learned value exists in a predetermined first judgment region; and judging malfunction of the second fuel feeding apparatus based on whether or not the second learned value exists in a predetermined second judgment region different from the predetermined first judgment region.

* * * * *